US005250926A

United States Patent [19]

McSwiggen

[11] Patent Number: 5,250,926

[45] Date of Patent: Oct. 5, 1993

[54] POTENTIOMETER WITH IMPROVED SEAL

[75] Inventor: John P. McSwiggen, South St. Paul, Minn.

[73] Assignee: Wilbrecht Electronics, Inc., St. Paul, Minn.

[21] Appl. No.: 875,425

[22] Filed: Apr. 29, 1992

[51] Int. Cl.[5] ..... H01C 10/32

[52] U.S. Cl. ..... 338/164

[58] Field of Search ..... 338/164, 163, 170, 162

[56] References Cited

U.S. PATENT DOCUMENTS 3,414,685 12/1968 Geib et al. .
3,629,780 12/1971 Burcham .
4,081,782 3/1978 Hildreth et al. .
4,117,444 9/1978 Hildreth et al. .
4,870,689 9/1989 Weiss .
5,053,742 10/1991 Masuda ..... 338/162

*Primary Examiner*—Marvin M. Lateef
*Attorney, Agent, or Firm*—Moore & Hansen

[57] ABSTRACT

The present invention provides a potentiometer having an improved seal for preventing intrusion of corrosive elements into the potentiometer or the socket in which the potentiometer is disposed, wherein the improved potentiometer comprises a housing having top and bottom members and a substantially annular sealing element sandwiched between the top and bottom housing members, the inner aperture of the sealing element sealingly engaging the rotor of the potentiometer, and, in one embodiment of the present invention, the outer edge of the annular sealing element sealing engaging the socket in which the potentiometer is disposed.

20 Claims, 3 Drawing Sheets

POTENTIOMETER WITH IMPROVED SEAL

The present invention relates generally to a seal for a potentiometer and particularly to a lip seal for a potentiometer.

BACKGROUND OF THE PRESENT INVENTION

Potentiometers find use in a variety of applications where a variable electrical resistance between input and output terminals is desired. Such uses include volume control, light control, instrumentation control, and the like. Most potentiometers include a housing in which a rotor turns, the rotor including electrical contacts that wipe across a resistive strip of a variable resister. In order for the rotor to be manipulated by the user, it must extend into the environment outside of the housing, thereby creating a path for the entry of corrosive elements into the interior of the housing where the electrical contacts of the potentiometer are placed. Because many potentiometers find an application in a potentially corrosive environment, this entry path into the housing is often sealed to prevent the intrusion by these externally originating, corrosion causing elements. In the application of the inventive potentiometer to be described below, that is, a hearing aid, such corrosive elements can include body fluids such as ear wax.

One known prior art potentiometer seal is the O-ring. This type of seal has typically been used to seal around a potentiometer rotor. For an O-ring seal to function effectively, however, the seal must be compressed such that it exerts a pressure against the rotor. Compressing an O-ring seal, however, affects its "running torque", that is the resistance offered by the O-ring to the rotor as it is turned therewithin. Compressing the O-ring seal, then, may make turning the rotor more difficult. A further problem with O-ring type seals are that they are relatively expensive. Yet another deficiency of an O-ring seal is that it is subject to quality variations that can effect the sealability of the seal. Since the seal must be compressed to function, the quality variations can effect the compressibility and thus the effectiveness of the O-ring as a seal. Still yet another deficiency of the O-ring seal typically found in a potentiometer is that the best pressure differential that such a seal can withstand is approximately ½ pound per square inch. Finally, the sealing integrity of the O-ring type of seal can actually diminish as the pressure differential from one side of the seal to the other side increases.

Another prior art type of seal used in certain potentiometer applications is the labyrinth seal. In that kind of application, a labyrinth seal typically comprises two or more concentric rings of different diameters that interleave with each other. Labyrinth seals are effective at keeping viscous fluids or particles out of the potentiometer housing, but such seals effectively wick thinner fluids into the housing. Most potentiometers have no inner seal other than the labyrinth seal; consequently, these thinner fluids can be wicked into corrosive contact with the electrical contacts of the variable resistor housed therein, leading to corrosion of the electrical contacts such that the potentiometer will cease to function. For example, in a potentiometer environment such as a hearing aid, a labyrinth seal may stop a thick, viscous fluid such as ear wax from entering the potentiometer housing, but may wick any thinner fluid that is present, such as sweat, regardless of the origin of the thinner fluid, into the housing where corrosion of the contacts may occur.

It would be desirable to have a potentiometer seal that would be less expensive than prior art seals; that would be less subject to manufacturing variations; that would not wick corrosive fluids into the housing; that would withstand greater pressure differentials; and that would have greater seal integrity as the pressure differential increased.

SUMMARY OF THE PRESENT INVENTION

The present invention provides an improved potentiometer and seal therefore and a method of manufacturing the same. The potentiometer includes a housing including top and bottom housing members and having a central passage. The bottom housing member defines a chamber therein. The inventive potentiometer also includes a rotor that is substantially contained within the chamber of the bottom housing member and that has a manipulable outer end that extends through the housing central passage out of the housing. An annular seal extends between the central passage of the housing and a side wall of the rotor outer end to form a sealing engagement therewith. The seal has an annular configuration with at least the center portion of the annular seal held between the top and bottom housing members. In one embodiment of the present invention, the annular seal may extend outwardly beyond the outer surface of the housing so as to form a sealing engagement with the socket into which the inventive potentiometer is inserted. The rotor carries a wiper having a pair of contacts that engage a base plate that is attached to the bottom of the housing and that carries a resistive strip that is engaged by one of the wiper contacts.

The foregoing objects of the invention will become apparent to those skilled in the art when the following detailed description of the invention is read in conjunction with the accompanying drawings and claims. Throughout the drawings, like numerals refer to similar or identical parts.

DETAILED DESCRIPTION OF THE PRESENT INVENTION

Figure 1:
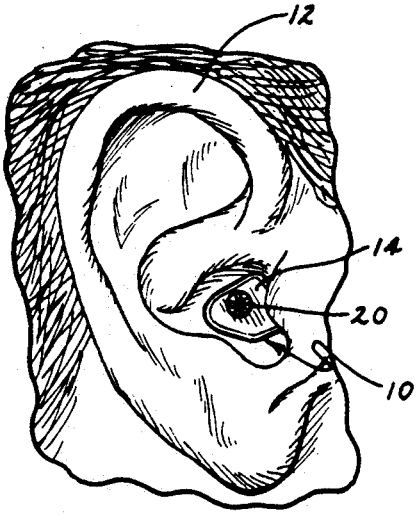
FIG. 1 shows an application for a potentiometer in accordance with the present invention wherein the inventive potentiometer is shown in a hearing aid positioned in an ear.

FIG. 1 illustrates a potential environment for a potentiometer in accordance with the present invention. Thus, a hearing aid 10 is shown positioned in a person's ear 12. The hearing aid 10 comprises a hearing aid body 14 and a potentiometer 20 in accordance with the present invention. Hearing aid body 14 includes the battery and all of the necessary electric and electronic circuitry needed for hearing aid 10 to function, with the exception of the circuitry needed to perform the function of the potentiometer 20 to be described hereinafter.

Figure 2:
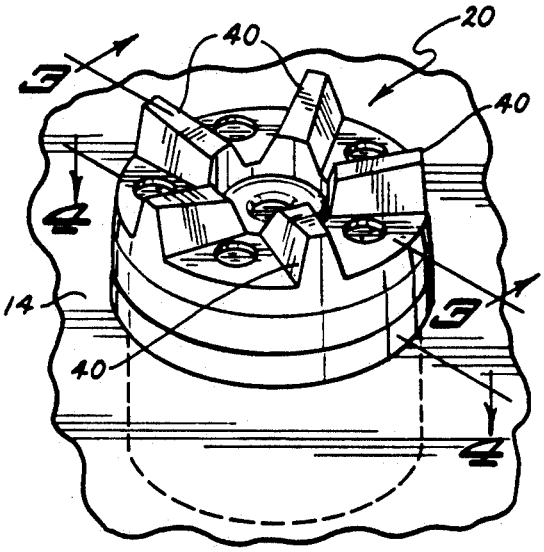
FIG. 2 shows a partial perspective view of the hearing aid of FIG. 1 and shows a perspective view partially in phantom of the potentiometer of FIG. 1.
Figure 3:
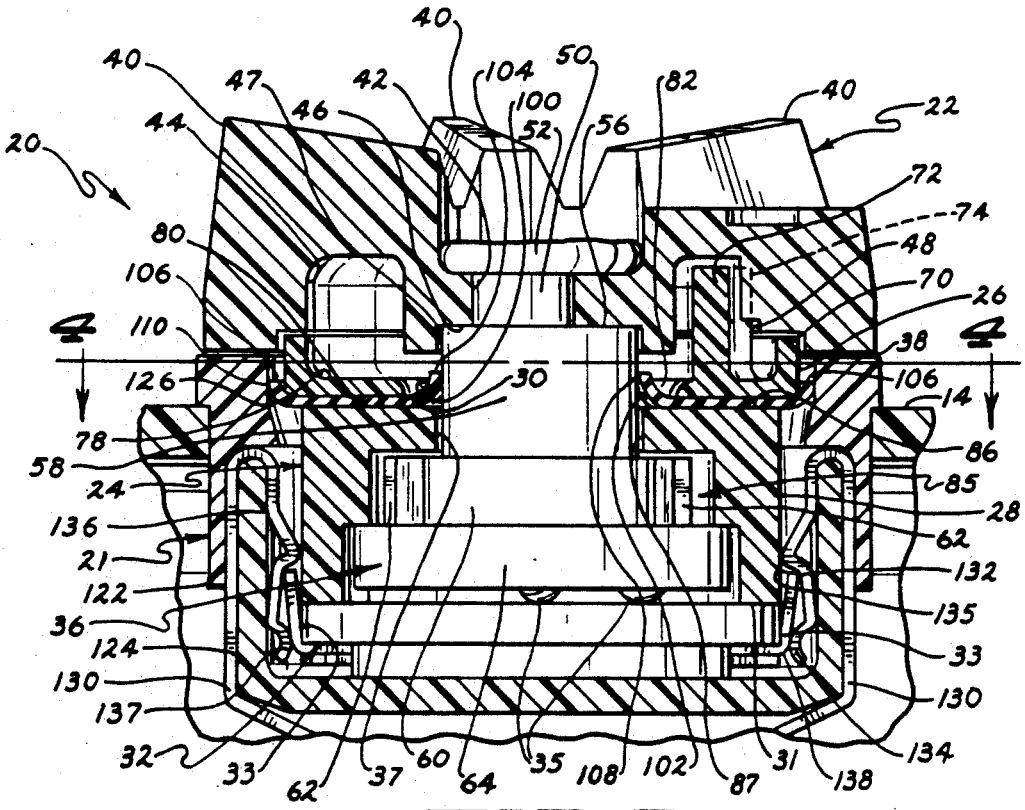
FIG. 3 shows a partial cross-sectional view of the potentiometer of FIGS. 1 and 2 taken along cutting plane 3—3 of FIG. 2 and shows in cross section a potentiometer housing having an inner lip seal engaging a rotor and an outer lip seal engaging a socket into which the potentiometer is disposed during use.
Figure 4:
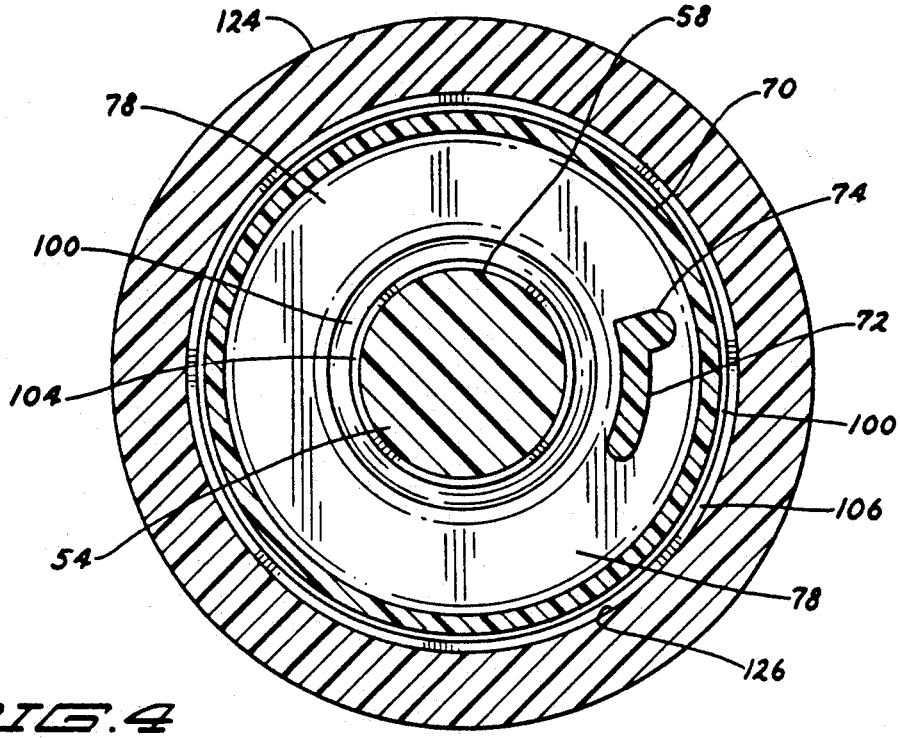
FIG. 4 is a cross-sectional plan view of the potentiometer of FIGS. 1 and 2 taken along cutting plane 4—4 of FIG. 3.
Figure 5:
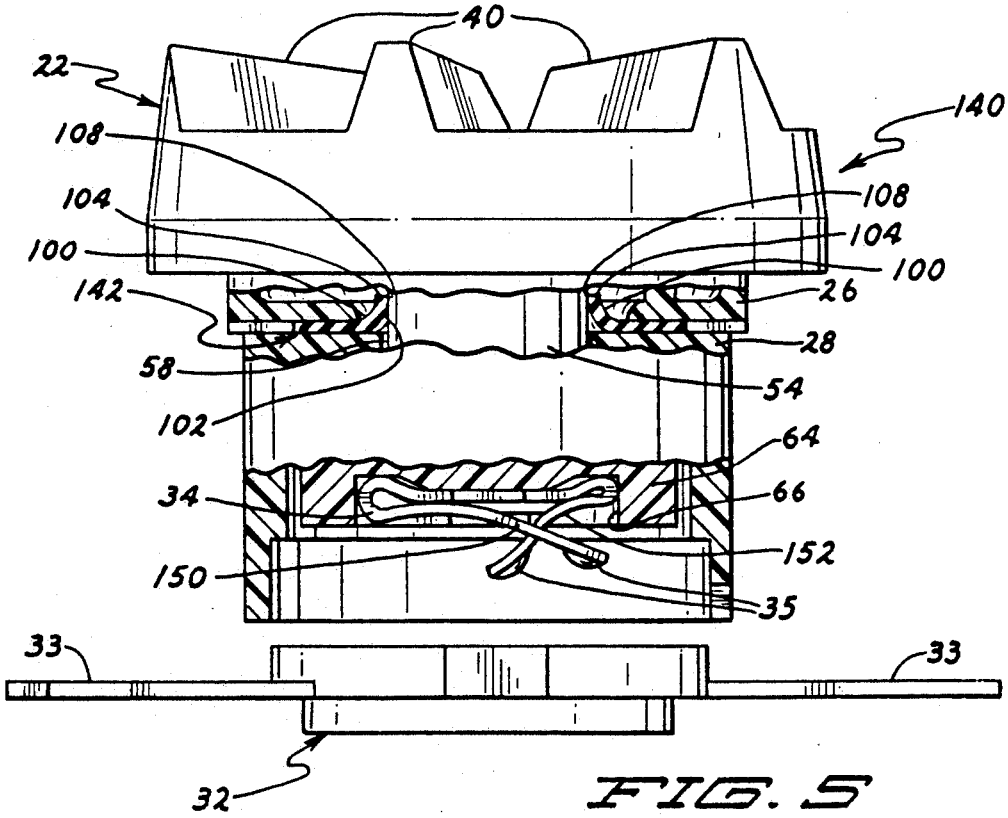
FIG. 5 illustrates in a partial cross sectional view another embodiment of the present invention wherein only an inner lip seal is provided between the sealing ring and the rotor.

Referring now to FIGS. 2 and 3, an embodiment of the present invention having an improved seal, in particular an inner and outer lip seal, will be described. Thus, in broad detail, the potentiometer 20 as shown in the Figures is disposed within a socket 21. Potentiometer 20 includes a rotatable, manipulatable control knob 22 and a housing 24 having top and bottom housing members or portions 26 and 28, respectively, that sandwich a sealing element 30 therebetween. Bottom housing member 28 has an open bottom 31 that receives a baseplate 32, which in turn holds a resistive strip (not shown) having electrical contacts 33. A wiper 34, best seen in FIG. 5, provides a varying resistive contact with the resistive strip held within baseplate 32. Wiper 34 is held in place in part by a rotor 36 contained partially within a housing chamber 37 formed within housing 24. Rotor 36 in turn is fixedly attached to knob 22 so that it is jointly rotatable therewith.

Potentiometer 20 functions in a manner similar to known potentiometers in that rotation of knob 22 causes rotor 36 to rotate therewith, thereby moving wiper 34 across the resistive strip contained within base plate 32 so as to vary the resistance between the electrical contacts of the potentiometer. In this well known manner the user can thus vary the volume of hearing aid 10, for example, or the illumination in a lighting system, or other such application. Because the functioning of a potentiometer in this regard is well known in the art, a further explanation will not be provided here. Further description of a potentiometer, a resistive strip, and how they function to vary the electrical output between the electrical contacts of the potentiometer can be found in many basic electrical device texts or, for example, in U.S. Pat. No. 4,803,458 to Trine, et al., assigned to the same assignee as the present invention. As can be seen in FIG. 3, in order to allow easy manipulation of the knob 22 of potentiometer 20, a tolerance gap 38 is maintained between knob 22 and top socket member 21, and between flange 26 and knob 22. Gap 38 provides an entry path and thus an easy access into the interior of potentiometer 20 such that corrosive materials can flow into the potentiometer and corrode the contacts 35 of wiper 34 and the electrical contacts 33.

With the foregoing explanation of the intended use of potentiometer 20 as well as the delineation of several major components thereof, a more detailed description of the potentiometer 20 will now be given. Thus, knob 22 has a generally circular configuration and includes a plurality of upwardly extending flanges 40. Flanges 40 aid the user in the rotational manipulation of the knob 22. Knob 22 further includes a central passage 42, an annular inner passage 44, and a sill 46 formed by a countersunk portion 47 surrounding central passage 42. A protuberance 48 extends into annular passage 44. Central passage 42 slidingly, but snugly receives a stem 50 of rotor 36. The outer end 52 of stem 50 is heat staked to knob 22 so that knob 22 may not be pulled free of rotor 36 and so that knob 22 and rotors 36 are jointly rotatable. Although the cross-section in FIG. 3 and the perspective shown in FIG. 2 indicate that stem 50 has a circular configuration, other configurations are within the scope of the present invention. Preferably, rotor stem 50 has at least one non-circular or planar side that is configured to match a similar non-circular or planar side in central passage 42 so as to cause rotor 36 and knob 22 to rotate jointly.

Rotor 36 is preferably manufactured from a synthetic material such as a thermoplastic material. If desired, it may be fiber reinforced. As noted above, rotor 36 includes a stem 50 that extends outwardly beyond housing 24. Stem 50 is attached, preferably integrally, to a rotor column 54 having a substantially planar top surface 56 that slidably and rotationally engages sill 46 of countersunk knob portion 47. As shown in FIG. 3, the upper portion of column 54 is received by countersunk portion 47 of knob 22. Column 54 has a substantially cylindrical configuration whose outer surface 58 forms a sealing surface engaged by sealing element 30, to be described in more detail below. Rotor 36 further includes another substantially cylindrical portion 60 having protuberances 62 thereon that engage on/off switch contacts (not shown) a knob 22 and thus rotor 36 are rotated. Potentiometer 20 functions in a known manner similar to other potentiometers having rotatable on/off switches and thus will not be described further. Rotor 36 further includes a base 64 having a countersunk portion 66 in which wiper 34 reposes, as best seen in the embodiment of the present invention shown in FIG. 5. Wiper 34 may take the same form in both embodiments and thus the countersunk portion 66 shown in FIG. 5 will be similarly configured in base 64 of rotor 36. Wiper 34 will be described below in more detail with respect to FIG. 5.

As shown in the embodiment of FIG. 3, housing 24 sandwiches sealing element 30 between top and bottom housing members 26 and 28, respectively. Top housing member 26 has a substantially annular configuration with an outer, upwardly extending, circular flange 70. Top housing member 26 further includes an upwardly extending detent 72 that includes a protuberance 74. Detent 72 moves within annular passage 44 of knob 22 as knob 22 is rotated by the user. Protuberance 74 engages protuberance 48 extending inwardly into annular passage 44 as the knob 22 is rotated between the on and off positions to provide the user with a tactile sensation of the on and off positions of the potentiometer and thus the hearing aid 10. As noted, top member 26 of housing 24 has a substantially annular, disk-like structure with a top surface 78 and a bottom surface 80 and includes a filleted surface 82 extending therebetween at the inner edge thereof. Housing top member 26 includes a centrally disposed passage or bore 84 through which rotor column 54 extends outwardly from within housing 24.

Bottom housing member 28 also has a generally cylindrical outside configuration. Member 28 includes a chamber 85 having a stepped internal configuration for receiving rotor 36. Thus bottom housing member chamber 85 receives column 54, cylindrical portion 60 and rotor base 64 of rotor 36. Bottom housing member 28 includes an annular top surface 86 upon which sealing element 30 rests. Thus, sealing element 30 is sandwiched between annular top surface 86 of bottom housing member 28 and bottom surface 80 of top housing member 26. Annular top surface 86 has a central passage or bore 87 substantially concentric with central passage 84 of top housing member 26. Top and bottom housing members 26 and 28 are preferably molded directly to each other by means of a plurality of flow through holes 88 (best seen in phantom in FIG. 6). That is, during the manufacture of potentiometer 20, housing 24 is made from a moldable, synthetic material wherein top and bottom housing members 26 and 28, respectively, are molded directly onto opposite sides of sealing element 30 such that molding material flows through the through holes 88 and such that housing top and bottom members 26 and 28, respectively, are fixed to each other with sealing element 30 lying therebetween.

Sealing element 30 also has a substantially annular disk-like configuration. Sealing element 30 includes top and bottom surfaces 100 and 102, inner side 104 and outer side 106, and inner and outer bottom edges 108 and 110, respectively. Sealing element 30 has a central aperture 112 having a smaller radius than the radius of column 54 of rotor 36. Sealing element 30 is disposed between the top and bottom housing members 26 and 28, respectively, such that seal top surface 100 engages bottom surface 80 of top housing member 26 and such that seal bottom surface 102 engages top surface 86 of bottom housing member 28. The flat, disc shape of sealing element 30 assures good contact between these seal and housing surfaces.

Potentiometer 20 is held within a socket 21 of hearing aid 10. Socket 21 comprises top and bottom socket members 122 and 124. Both top and bottom socket members 122 and 124, respectively, have a substantially cylindrical configuration. In particular, top socket member 122 has a substantially annular configuration having an inner surface 126 disposed at a radius smaller than the radius of outer side 106 of sealing element 30. A plurality of electrical contacts 130, two of which are shown in FIG. 3, extend from electrical contact with on/off switch contacts (not shown) and the resistive strip contacts 33 of potentiometer 20, all within socket 21, and out to the hearing aid body 14, which houses the other electrical components of hearing aid 10. Each of the electrical contacts 130 comprise a substantially U-shaped structure as shown in FIG. 3 and include a pair of contact points 132 and 134 that engage each electrical contact of potentiometer 20 at two locations, thereby providing a sure electrical connection between the electrical components of potentiometer 20 and the electrical components of the hearing aid body 14.

As can be seen from the Figure, the free end 135 of potentiometer contact 33 is disposed beneath an inwardly extending bend 136 of contact 130. This relative disposition of the free end 135 and bend 136 facilitates the retention of potentiometer 20 within socket 120 since the free end 135 is trapped below bend 136. It also provides the first of the aforementioned two electrical contacts between potentiometer leads 33 and application o hearing aid leads 130. Contacts 130 include a second inwardly extending bend 137 that electrically engages a second, distinct portion 138 of contact or potentiometer lead 33. Thus, the application or hearing aid leads 130 and the potentiometer leads 33 are each electrically connected at two distinct locations, thereby providing a substantially failure free mode of operation. That is, while a single electrical contact may at times work free of its electrical connection with another component, the likelihood of such an occurrence happening where two distinct contact points exist is remote.

During the manufacturing process, which will be explained in greater detail below, rotor 36 is inserted through housing 24 from the open bottom 31 such that it is positioned within chamber 85 of bottom housing member 28 substantially in the manner shown in FIG. 3. Because the inner radius of sealing element inner side 104 is less than the radius of column 58, the inner side 104 of sealing element 30 is deformed upwardly as shown such that the bottom surface 102 of sealing element 30 sealingly engages sealing surface 58 of column 54, thus forming an arcuate configuration along the inner edge of sealing element 30. Similarly, because the inner surface 126 of socket top member 122 is disposed at a lesser radius than that of outer side 106 of sealing element 30, when potentiometer 20 is inserted into socket 21, the outer side 106 of sealing element 30 will be deformed upwardly such that sealing element bottom surface 102 will sealingly engage the inner surface 126 of the top socket member 122, thus forming an arcuate configuration along the outer edge of the sealing element 30. Sealing element 30, which can be made from a polyimide-type of material such as Dupont Kapton® Type H film, provides a seal able to withstand a significantly greater pressure differential than prior art seals. Because the seal is deformed upwardly on both the inner and outer sides 104 and 106, the pressure exerted by an external fluid will force inner and outer seal edges 108 and 110, respectively, against their respective seating surfaces 58 and 126, which will improve the quality of the seal. In one test on the seal of the present invention, the seal withstood a pressure differential of at least 85 psi, or approximately a minimum of 170 times the prior art O-ring seal structure, before the fixture holding the potentiometer broke. Thus, the seal formed by sealing element 30 appears capable of functioning at even higher pressure differentials. Thus, sealing element 30 provides a lip seal on both the inner and outer sides 104 and 106, respectively, with the sealing surface 58 of column 54 and the inner surface 126 of top socket member 122, respectively, so as to effectively prohibit the intrusion of corrosive materials into the interior of potentiometer 20 and socket 21 through the tolerance gap 38.

Referring now to FIG. 5, another embodiment of the present invention is shown wherein only an inner lip seal is provided. Thus, FIG. 5 illustrates a potentiometer 140 in isolation from its socket. Potentiometer 140 includes a sealing element 142 sandwiched between top and bottom housing members 26 and 28, which are constructed substantially similar to that shown in FIG. 3. As noted, sealing element 142 provides a seal only along the inner side thereof. Thus, sealing element 142 has a bottom surface 102 that sealingly engages the sealing surface 58 of column 54.

Also illustrated in FIG. 5 is a cross section of rotor base 64 showing countersunk portion 66 into which wiper 34 is reposed. Wiper 34 comprises a first arm 150 bent toward the center of the wiper and having a central aperture (not shown) disposed at the free end thereof. Wiper 34 further includes a second arm 152 that is also bent toward the center of the wiper 34 and whose free end is inserted through the unseen aperture of first arm 150. That is, the free end of the second arm 152 extends through the unseen central aperture of the first arm. Arms 150 and 152 are biased downwardly such that when base plate 32 is attached to bottom housing member 28, contacts 35 of arms 150 and 152 are pushed into engagement with the resistive strip disposed within base plate 32. The electrical contact 35 of first arm 150 engages the resistive strip held within baseplate 32 while the electrical contact 35 of second arm 152 engages an electrical lead of the resistive strip. As rotor 36 is rotated, wiper 34 rotates jointly therewith, causing contact 35 of first arm 150 to wipe across the resistive strip and vary the resistance of the circuit in a well known manner, thus providing volume control for the particular application illustrated herein.

Figure 6:
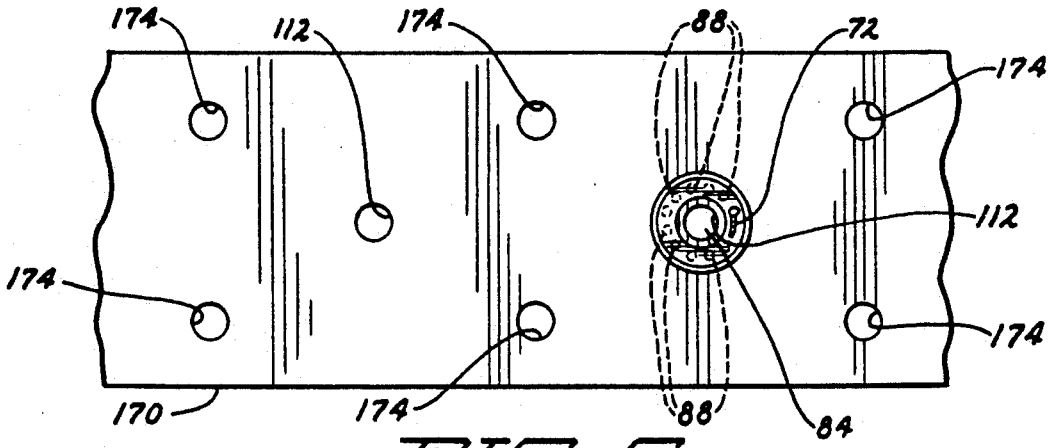
FIG. 6 illustrates one step in a method of making a potentiometer with an improved seal such as that shown in FIGS. 1–4 in accordance with the present invention and shows a strip of fixturing material to which the potentiometer housing has been molded with the fixturing material also serving as the material forming the lip seal.
Figure 7:
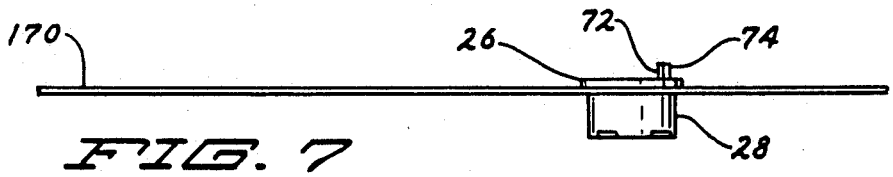
FIG. 7 is a plan view of the view shown in FIG. 6.

Referring now to FIGS. 6–9, a method of manufacturing the housing 24 and thus potentiometer 20 and 140 will be described. FIGS. 6 and 7 on one hand and 8 and 9 on the other illustrate the method for constructing housing 24 with sandwiched sealing elements 30 and 142, respectively. In the process of manufacturing potentiometer 20 and 140, there is first provided a carrier or fixturing strip 170 and 172, respectively from which seals 30 and 142 are formed. Fixturing strips or tapes 170 and 172 are provided along the lateral edges thereof with a plurality of indexing holes 174 for selective movement of the fixturing strips 170 and 172. Indexing holes 174 may be punched therein, drilled with a laser or other known device, or provided in other known manners. Both fixturing strips 170 and 172 are also prepunched with holes 112, which serve as the apertures 112 through which rotor 36 extends.

Referring specifically now to FIGS. 6 and 7, the construction of the housing 24 of potentiometer 20 will now be described. As previously noted, flow through holes 88 will also be punched or otherwise provided in the same manner as indexing holes 174 in fixturing strip 170. Housings 24 will then be molded directly onto the fixturing strip 170. During the molding operation, top and bottom housing members 26 and 28 will be molded onto opposite sides of strip 170 such that the central passage 84 of top housing member 26 and the central passage 87 of bottom housing member 28 are substantially concentric with hole 112. Molding material from top and bottom housing members 26 and 28 will flow through the flow through holes 88 such that housing top and bottom members 26 and 28, respectively, are rigidly affixed to one another with fixturing strip 170 or 172 sandwiched therebetween. Although not shown, preferably a flow through hole is disposed beneath detent 72 to provide additional strength thereto, thus making detent 72 in essence a cantilevered beam. Fixturing strip 170 will then be cut around top and bottom housing members 26 and 28 in a substantially circular manner such that an annular disk-like portion remains substantially sandwiched between the top and bottom housing members and such that sealing element 30 is formed thereby. Thus, fixturing strip 170 will be cut such that sealing element 30 has its outer edge 106 at a larger radius than the outer radius of either top or bottom housing member 26 or 28. Thus, in this manner housing 24 will be formed with sealing element 30 sandwiched therebetween.

Normally, before removal of the housing 24 from fixturing strip 170, the potentiometer 20 will be built in its entirety. Thus, after the housing 24 has been molded onto fixturing strip 170, the housing will then be fed past assembly stations where the potentiometer 20 will be built. Rotor 36 will be pushed through the seal which, because of its lesser inner radius, will hold the rotor 36 in place and provide the inner, fluid-tight seal. The wiper 34 will then be reposed within the countersunk portion 66 of rotor base 64 and the base plate 32 will then be attached to the housing bottom. The housing with the potentiometer and base plate attached thereto will then be turned over and the knob 22 will be heat staked onto rotor stem 50, thus completing the construction of the potentiometer 20. The finished potentiometer may then be punched free of the carrier or fixturing strip 170. Again, as noted in the construction of potentiometer 20, potentiometer 20 will be punched free such that excess material will be left around the housing so that the potentiometer can also seal against the hearing aid socket 21.

Figure 8:
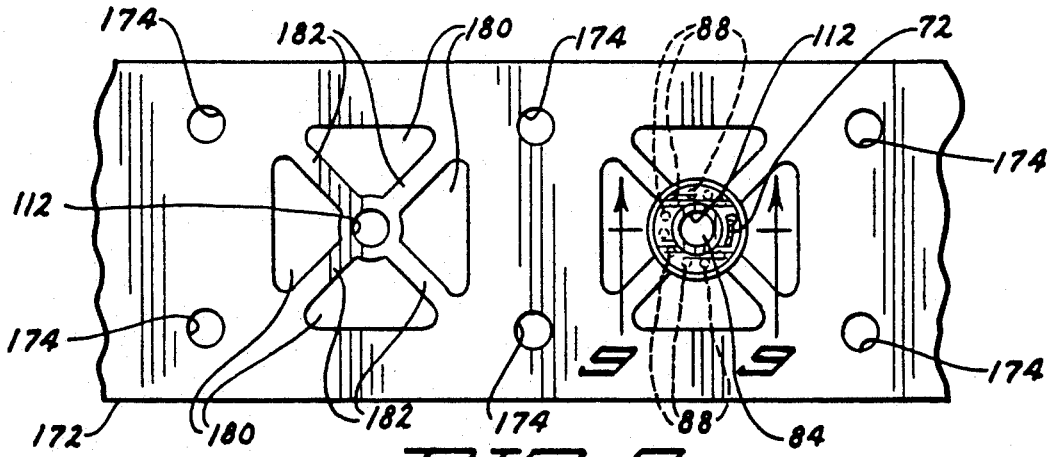
FIG. 8 shows a step in the process of manufacturing a potentiometer with an improved seal such as that shown in FIG. 5 wherein only the inner seal is provided.
Figure 9:
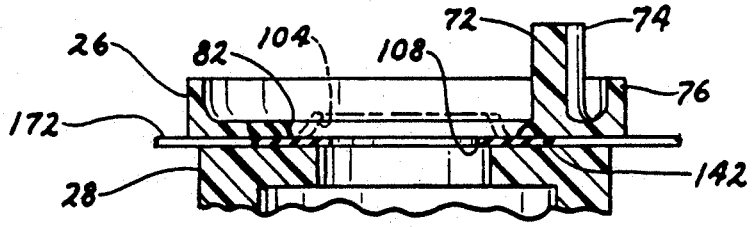
FIG. 9 shows a partial cross-sectional view of the potentiometer housing and fixturing strip shown in FIG. 8 taken along cutting plane 9—9 thereof.

Referring to FIGS. 8 and 9, it will be noted that the assembly procedure for the potentiometer 140 is substantially similar to that given above. However, since potentiometer 140 is constructed so that sealing element 142 seals only on its inner edge against sealing surface 58 of rotor column 54, that is, no outer seal will be provided, additional material will be removed from fixturing strip 172 about hole 112 to facilitate the finishing process after potentiometer 140 has been punched free of fixturing strip 172. That is, by punching additional apertures 180, additional material is removed from the vicinity of hole 112 such that only a plurality of thin strips 182 remain to hold that portion of fixturing strip 172 that will become sealing element 142 in place during the molding operation. Thus when potentiometer 140 is punched free of fixturing strip 172, it will be necessary only to trim strips 182 flush with the outer surface of the housing 24 rather than trimming substantially the entire distance around the outer surface of the housing 24 as is necessary with the housing 24 for potentiometer 20.

As shown in FIG. 9, before the insertion of rotor 36 into housing 24, sealing element 142, like fixturing strips 170 and 172, has a substantially planar configuration before the rotor 36 is pushed through aperture 112. After rotor 36 has been pushed upwardly through the housing 24, inner side 104 of sealing element 142 will be deformed upwardly as shown in phantom in the Figure.

The lip seals formed by sealing elements 30 and 142 provide several advantages over known prior art seals. Because of the strength of the material forming the seal, the seal material itself may be used as fixturing strips as indicated in FIGS. 6–9. Because of the low cost of the material forming the sealing element, lip seals such as that shown in the Figures can be made for approximately one third (⅓) of the cost of conventional 0-ring types of seals. The lip seal can also form seals internally with the rotor and externally against the socket into which the potentiometer is seated, as clearly shown in the embodiments illustrated herein.

Another advantage of a potentiometer constructed in accordance with the present invention is that running torque will be the same for all potentiometers. Since most of the torque results from the rotor surface 58 rubbing on the seal bottom surface 102, the more consistent seal force of the present invention results in consistent torque. The consistent seal force occurs because the seal material is deformed from its elastic stress region into its plastic stress region. As is well known, all materials exhibit elastic behavior when placed under stress. That is, the material will stretch when stressed and then substantially return to its original shape when the stress is removed. When the stress becomes too large for particular material, however, the material will deform plastically and not return to its former shape when the stress is removed as it would when subjected to stress in the elastic region. Thus, because sealing elements 30 and 142 are stressed into the plastic region of the seal material, all running torques will be the same for all rotors. That is, regardless of what happens during the manufacturing process, all energy in the seal after insertion of the rotor will be the maximum elastic stress because the plastic stress will relieve itself by deforming the seal. Because the elastic energy is a function of the material properties, all of the potentiometers will have the same seal force and running torque regardless of the size of the individual rotors. Thus, manufacturing variations will also not affect a lip seal such as that embodied in the present invention since the running torques will all be the same and compression of the seal is not relied upon in order to make the seal function. Furthermore, with the present invention the seal is achieved by placing the sealing edges under tension through its deformation from its elastic zone to its plastic zone, rather than by placing the seal under compression as happens with an O-ring seal.

Yet another advantage of a potentiometer constructed in accordance with the present invention is that because of the upward deformation of the seal edges, application of increasing pressure increases the seal integrity. That is, it becomes more difficult to breach the seal as the pressure is applied to the seal since the seal edge must be deformed downwardly from its upward position. The present invention thus provides a good high-pressure seal that increases in integrity with increases of fluid pressure.

The sealing elements 30 and 142, which are preferably made of Dupont Kapton Type H film, are strongly temperature resistant with no melting point, thereby making them ideal for molding the housing directly onto the fixturing strip. Additionally, since soldering temperatures should generally not exceed 525° F., See MIL-STD-2000A for example, the seal is useful for wide ranging electronics applications. As noted a preferred material for use in a potentiometer having a lip seal in accordance with the present invention is a material sold under the mark of Kapton® manufactured by Dupont, though other materials will also suffice.

Preferably, the housing and knob are formed from thermoplastic materials, the former preferably being a fiber-reinforced thermoplastic and the latter be a non-reinforced thermoplastic since wear will be less if both are not reinforced.

The present invention having thus been described, other modifications, alterations, or substitutions may now suggest themselves to those skilled in the art, all of which are within the spirit and scope of the present invention. For example, the present invention has been illustrated and described primarily in reference to a single application, that of a hearing aid designed and built for use by a human being. It will be understood that the present invention is not so limited in use and can be used wherever a potentiometer is used and is subject to being invaded by external corrosive elements that can corrode the electrical contacts of the potentiometer and thus destroy or impair its ability to function properly. It is therefore intended that the present invention be limited only by the scope of the attached claims below.

What is claimed is:

1. A potentiometer comprising:

a housing having a central bore and defining a chamber therein;

a rotor having inner and outer ends, said rotor outer end extending through said housing central bore and having a manipulative portion for rotating said rotor;

sealing means extending between said central bore and said rotor outer end, said sealing means being provided for substantially preventing the intrusion of corrosive materials into said housing;

a wiper carried by said rotor inner end, said wiper including a pair of contacts; and a base plate attached to said housing and carrying a resistive strip engaged by one of said contacts.

2. The potentiometer of claim 1 wherein said rotor outer end has a substantially cylindrical side wall and said sealing means comprises an annular disk shaped member having inner and outer edges, said inner edge sealingly engaging said side wall of said rotor outer end, said outer seal edge being carried by said housing.

3. The potentiometer of claim 2 wherein said housing comprises top and bottom housing members, said members sandwiching said outer edge of said sealing means therebetween.

4. The potentiometer of claim 3 wherein said housing has a bottom opening and said rotor is inserted into said housing from said bottom opening such that said sealing engagement between said inner edge and said side wall of said rotor outer end moves said inner edge in the direction of insertion of said rotor so that said inner edge forms an arcuate configuration.

5. The potentiometer of claim 3 wherein said housing has a bottom opening and wherein said substantially cylindrical side wall of said rotor is defined in part by a first diameter and said inner edge has a substantially circular configuration defined by a second diameter, said second diameter being smaller than said first diameter, and wherein said rotor is inserted into said housing from said bottom opening and thru said second diameter of the annular shaped sealing member such that said sealing engagement between said inner edge and said side wall of said rotor outer end causes said inner edge of said disk shaped member to form an arcuate configuration.

6. The potentiometer of claim 2 wherein said housing has a bottom opening and said rotor is inserted into said housing from said bottom opening and thru said annular shaped sealing member such that said sealing engagement between said inner edge and said side wall of said rotor outer end moves said inner edge in the direction of insertion of said rotor so that said inner edge forms an arcuate configuration.

7. The potentiometer of claim 2 wherein said housing has a bottom opening and wherein said substantially cylindrical side wall of said rotor is defined in part by a first diameter and said inner edge has a substantially circular configuration defined by a second diameter, said second diameter being smaller than said first diameter, and wherein said rotor is inserted into said housing from said bottom opening such that said sealing engagement between said inner edge and said side wall of said rotor outer end causes said inner edge to form an arcuate configuration.

8. The potentiometer of claim 1 wherein said housing comprises top and bottom engaged members and said sealing means comprises a disk shaped member having inner and outer edges, said top and bottom housing members sandwiching said disk shaped member therebetween such that said inner edge sealingly engages said side wall of said rotor outer end and said outer edge extends beyond said housing.

9. The potentiometer of claim 8 and further including a socket, said socket configured to receive said housing and defined in part by a substantially circular socket inner wall, said outer edge of said sealing means sealingly engaging said socket inner wall.

10. The potentiometer of claim 9 wherein said housing is received by said socket such that the sealing engagement between said socket inner wall and said outer edge of said sealing means causes said outer edge to assume an arcuate configuration.

11. The potentiometer of claim 10 wherein said housing has a bottom opening and said rotor is inserted into said housing from said bottom opening such that said sealing engagement between said inner edge and said side wall of said rotor outer end moves said inner edge in the direction of insertion of said rotor so said inner edge forms an arcuate configuration.

12. The potentiometer of claim 1 wherein said sealing means is made from a polyimide-type of material.

13. The potentiometer of claim 1 wherein said annular, disk shaped sealing member is substantially flat, and said housing comprises top and bottom housing members between which said sealing member is sandwiched.

14. A method of manufacturing a housing having a lip sealing element for a potentiometer, said housing including top and bottom portions and further including a sealing element sandwiched between said portions, each said portion having a central passage of at least a first radius with said central passage receiving a potentiometer rotor, said method comprising:

providing a fixturing strip made of the same material as said sealing element, said fixturing strip having a plurality of indexing holes along each side thereof for selective movement of said fixturing strip;

providing a substantially circular hole in said fixturing strip, said hole having a radius less than said first radius;

providing a plurality of fixturing apertures about said hole in said fixturing strip;

molding said top and bottom housing portions on opposite sides of said fixturing strip such that said central bores are substantially concentric with said fixturing strip hole and such that the material of said housing portions flows through said fixturing holes and attaches said top and bottom housing portions to each other; and removing said housing from said fixturing strip by cutting said strip, whereby said fixturing strip forms said sealing element sandwiched between said top and bottom housing portions.

15. The method of claim 14 wherein said top and bottom portions each have a substantially cylindrical configuration and each have an outer radius less than or equal to a second radius, said second radius being greater than said first radius, said method further comprising:

cutting said fixturing strip around said housing such that said sealing element has a substantially annular configuration having an outer radius greater than said second radius.

16. The method of claim 14 wherein said sealing means is made from a polyimide-type of material.

17. A method of manufacturing a potentiometer including a housing having a lip sealing element for said potentiometer, said housing including top and bottom portions and further including a sealing element sandwiched between said portions, each said portion having a central passage of at least a first radius, said central passage receiving a potentiometer rotor, said rotor further including at least one rotor side wall, having a wiper receptacle, and having a manipulable outer end, said method comprising:

providing a fixturing strip made of the same material as said sealing element, said fixturing strip having a plurality of indexing holes along each side thereof for selective movement of said fixturing strip;

providing a substantially circular hole in said fixturing strip, said hole having a radius less than said first radius;

providing a plurality of fixturing apertures about said hole in said fixturing strip;

molding said top and bottom housing portions on opposite sides of said fixturing strip such that said central bores are substantially concentric with said fixturing strip hole and such that the material of said housing portions flows through said fixturing holes and attaches said top and bottom housing portions to each other, said bottom housing portion having an open bottom; and removing said housing from said fixturing strip by cutting said strip, whereby said fixturing strip forms said sealing element sandwiched between said top and bottom housing portions; and placing said rotor within said housing by inserting said rotor into said housing through said bottom opening such that said rotor side wall sealingly engages said sealing element;

disposing a wiper having a pair of electrical contacts in said wiper receptacle of said rotor; and attaching a base plate having a resistive strip to said bottom housing portion such that said wiper contacts engage said resistive strip.

18. The method of claim 17 wherein said top and bottom housing portions each have a substantially cylindrical configuration and each have an outer radius less than or equal to a second radius, said second radius being greater than said first radius, said method further including:

cutting said fixturing strip around such housing such that said sealing element has a substantially annular configuration having an outer radius greater than said second radius.

19. The method of claim 17 wherein said sealing means is made from a polyimide-type of material.

20. The method of claim 17 wherein said circular hole has an inner edge and said inner edge sealingly engages said rotor side wall such that said inner edge is deformed into an arcuate configuration.

* * * * *

UNITED STATES PATENT AND TRADEMARK OFFICE

CERTIFICATE OF CORRECTION

PATENT NO. : 5,250,926

DATED : October 5, 1993

INVENTOR(S) : John P. McSwiggen

It is certified that error appears in the above-identified patent and that said Letters Patent is hereby corrected as shown below:

col 5, line 68, delete "o" and insert -- or -- therefore.

col 8, line 57, delete "5/8" and insert -- 1/3 -- therefore.

claim 15, col 12, lines 1-2, delete "comprising" and insert -- including -- therefore.

Signed and Sealed this

Ninth Day of May, 1995

Bruce Lehman

*Attest:*

BRUCE LEHMAN

*Attesting Officer*

*Commissioner of Patents and Trademarks*